US010316650B2

(12) United States Patent
Irani

(10) Patent No.: US 10,316,650 B2
(45) Date of Patent: Jun. 11, 2019

(54) GAS PHASE DETECTION OF DOWNHOLE FLUID SAMPLE COMPONENTS

(71) Applicant: Halliburton Energy Services, Inc., Houston, TX (US)

(72) Inventor: Cyrus Aspi Irani, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/513,098

(22) PCT Filed: Nov. 4, 2014

(86) PCT No.: PCT/US2014/063870
§ 371 (c)(1),
(2) Date: Mar. 21, 2017

(87) PCT Pub. No.: WO2016/072976
PCT Pub. Date: May 12, 2016

(65) Prior Publication Data
US 2017/0292368 A1 Oct. 12, 2017

(51) Int. Cl.
*E21B 47/10* (2012.01)
*E21B 49/10* (2006.01)

(52) U.S. Cl.
CPC ..... *E21B 47/102* (2013.01); *E21B 49/10* (2013.01)

(58) Field of Classification Search
CPC ..... E21B 47/102; E21B 49/10
USPC ..... 324/465
See application file for complete search history.

(56) References Cited

U.S. PATENT DOCUMENTS

| | | | | |
|---|---|---|---|---|
| 8,631,866 | B2 * | 1/2014 | Nguyen | E21B 36/00 166/250.08 |
| 9,719,849 | B2 * | 8/2017 | Perkins | G01J 1/0488 |
| 2004/0104355 | A1 | 6/2004 | Difoggio et al. | |
| 2009/0078036 | A1 | 3/2009 | Terabayshi et al. | |
| 2009/0128818 | A1 | 5/2009 | Goodwin et al. | |
| 2011/0093200 | A1 | 4/2011 | Hsu et al. | |
| 2013/0056626 | A1 | 3/2013 | Shen et al. | |

FOREIGN PATENT DOCUMENTS

| | | |
|---|---|---|
| WO | WO 2009/024202 A2 | 2/2009 |
| WO | WO 2013/089692 A1 | 6/2013 |

OTHER PUBLICATIONS

International Search Report and the Written Opinion of the International Search Authority, or the Declaration, dated Jul. 17, 2015, PCT/US2014/063870, 13 pages, ISA/KR.

* cited by examiner

*Primary Examiner* — Reena Aurora
(74) *Attorney, Agent, or Firm* — Haynes and Boone, LLP

(57) ABSTRACT

A downhole tool for analyzing reservoir fluids includes a mechanism for extracting a fluid sample (e.g., single phase liquid sample) from a wellbore, a sample depressurization module to liberate the gas phase from the extracted fluid sample, and a gas sensor utilized to detect one or more components of the gas phase. In certain embodiments, the downhole tool may be a formation testing tool, and the depressurization module may be a bubble point measurement module.

18 Claims, 6 Drawing Sheets

GAS PHASE DETECTION OF DOWNHOLE FLUID SAMPLE COMPONENTS

PRIORITY

The present application is a U.S. National Stage patent application of International Patent Application No. PCT/US2014/063870, filed on Nov. 4, 2014, the benefit of which is claimed and the disclosure of which is incorporated herein by reference in its entirety.

FIELD OF THE DISCLOSURE

The present disclosure relates generally to downhole fluid analysis and, more specifically, to a downhole tool which liberates and analyzes the gas phase of a fluid sample to determine one or more components of the fluid sample.

BACKGROUND

In hydrocarbon exploration, wireline formation test strings are routinely utilized to determine compositions of reservoir fluids. One component of considerable interest for early determination is Hydrogen Sulfide ($H_2S$). $H_2S$ is an extremely toxic species which, given the right environment, can be extremely corrosive and dangerous to personnel. Consequently, an early understanding of the presence and concentration of $H_2S$ in the reservoir fluid represents information of considerable significance.

However, conventional analysis of liquid reservoir fluid faces some challenges. For example, the issue with optical detection of liquid phase $H_2S$ is that the frequency range in which $H_2S$ has an optical signal is very crowded, as it overlaps significantly with the optical signals of a large number of other components that make up hydrocarbon fluid. This masking of the optical signal makes both the detection and quantification of $H_2S$ single phase liquid hydrocarbon systems very difficult.

Accordingly, there is a need in the art for an improved approach to the analysis of reservoir fluids.

DESCRIPTION OF ILLUSTRATIVE EMBODIMENTS

Figure 1:
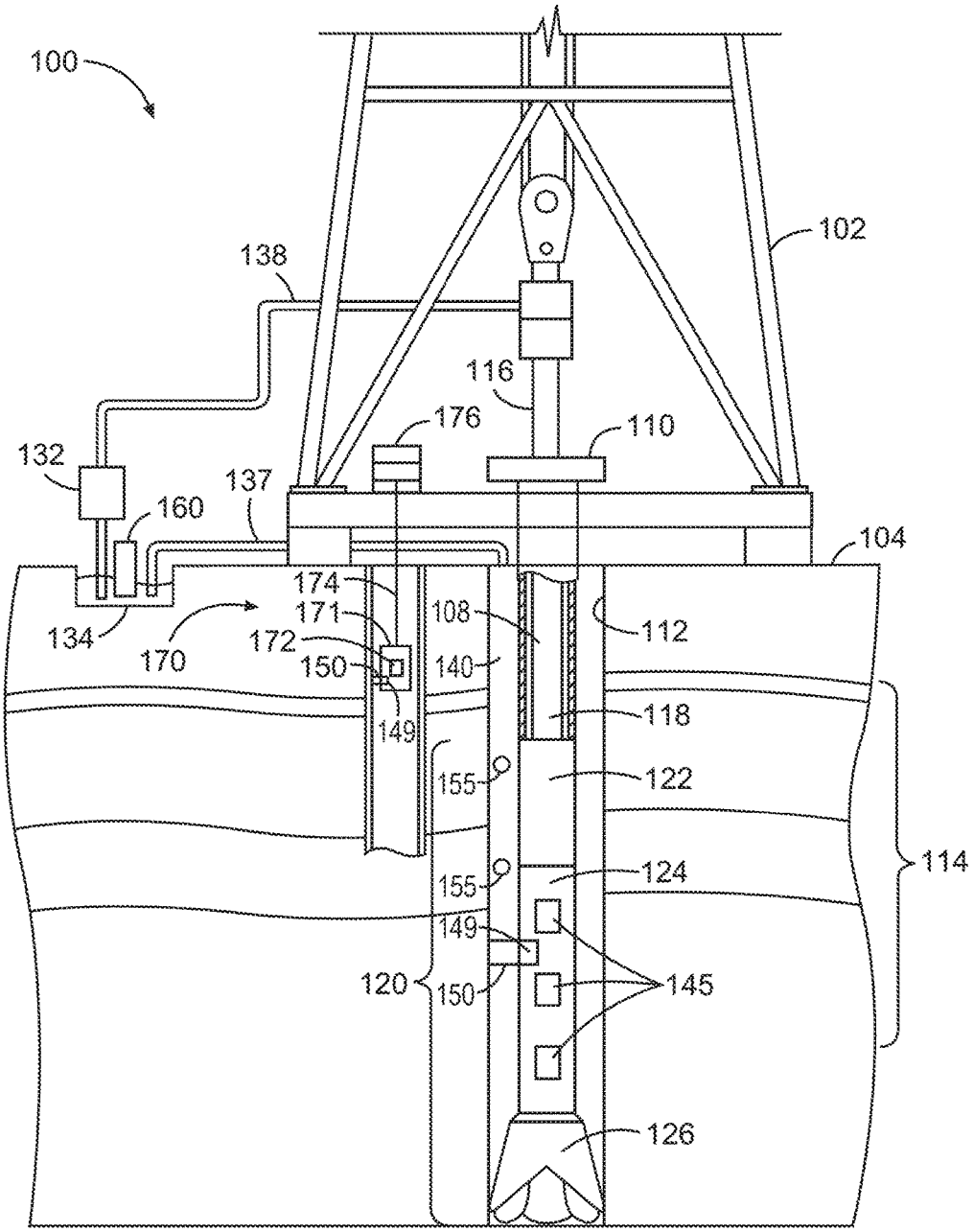
FIG. 1 illustrates a system for drilling and wireline operations according to an illustrative embodiment of the present disclosure.

Illustrative embodiments and related methodologies of the present disclosure are described below as they might be employed in a downhole tool for gas phase detection of fluid components. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As described herein, illustrative embodiments of the present disclosure provide downhole tools for analyzing fluid samples. In a generalized embodiment, the downhole tool includes a mechanism for extracting a fluid sample (e.g., single phase liquid sample) from a wellbore, a sample depressurization module to liberate the gas phase from the extracted fluid sample, and a gas sensor utilized to detect one or more components of the gas phase. In certain embodiments, the downhole tool may be a formation testing tool, and the depressurization module may be a bubble point measurement module.

As briefly mentioned in the Background Section, conventional optical detection of certain components of hydrocarbon fluid is problematic in that the optical signals are masked by other signals sharing the same frequency ranges of the desired component. However, as described in the current disclosure, the accuracy of component detection is greatly improved when the sample is analyzed in the gas phase, as the masking is minimized or alleviated due to the limited number and nature of the gas phase components. Although the fluid analysis tools described herein may be standalone devices, in certain embodiments they are integrated into formation testing tools which perform bubble point monitoring of reservoir fluid for the purposes of fluid characterization and to confirm the fluid is contamination free. By definition, a bubble point measurement requires that a gas phase be liberated from a single phase liquid. This liberated gas phase is subsequently analyzed by the gas sensors described herein.

In a generalized method, the downhole tool is deployed downhole whereby it extracts a fluid sample from the wellbore. The extracted fluid sample then flows through a flow line of the downhole tool and into a depressurization module. The depressurization module manipulates the pressure of the fluid sample to thereby liberate the gas phase of the fluid sample. For example, this liberation may be achieved utilizing the bubble point of the fluid sample. Once the gas is liberated, the gas is communicated to one or more gas sensors positioned within the downhole tool, where the gas sensors are then used to detect one or more components of the gas. The detected components may be, for example, $H_2S$, mercury, Carbon Dioxide ($CO_2$), C1-C13 hydrocarbons, or Hydrogen Fluoride (HF). Accordingly, downhole in-situ detection of various fluid components is provided.

FIG. 1 illustrates a system 100 for drilling operations according to an illustrative embodiment of the present disclosure. It should be noted that the system 100 can also include a system for pumping or other operations. System 100 includes a drilling rig 102 located at a surface 104 of a wellbore. Drilling rig 102 provides support for a down hole apparatus, including a drill string 108. Drill string 108 penetrates a rotary table 110 for drilling a borehole/wellbore 112 through subsurface formations 114. Drill string 108 includes a Kelly 116 (in the upper portion), a drill pipe 118 and a bottom hole assembly 120 (located at the lower portion of drill pipe 118). In certain illustrative embodiments, bottom hole assembly 120 may include drill collars 122, a downhole tool 124 and a drill bit 126. Downhole tool 124 may be any of a number of different types of tools including measurement-while-drilling ("MWD") tools, logging-while-drilling ("LWD") tools, etc.

During drilling operations, drill string 108 (including Kelly 116, drill pipe 118 and bottom hole assembly 120) may be rotated by rotary table 110. In addition or alternative to such rotation, bottom hole assembly 120 may also be rotated by a motor that is downhole. Drill collars 122 may be used to add weight to drill bit 126. Drill collars 122 also optionally stiffen bottom hole assembly 120 allowing it to transfer the weight to drill bit 126. The weight provided by drill collars 122 also assists drill bit 126 in the penetration of surface 104 and subsurface formations 114.

During drilling operations, a mud pump 132 optionally pumps drilling fluid (e.g., drilling mud), from a mud pit 134 through a hose 136, into drill pipe 118, and down to drill bit 126. The drilling fluid can flow out from drill bit 126 and return back to the surface through an annular area 140 between drill pipe 118 and the sides of borehole 112. The drilling fluid may then be returned to the mud pit 134, for example via pipe 137, and the fluid is filtered. The drilling fluid cools drill bit 126, as well as provides for lubrication of drill bit 126 during the drilling operation. Additionally, the drilling fluid removes the cuttings of subsurface formations 114 created by drill bit 126.

Still referring to FIG. 1, downhole tool 124 may include one to a number of different sensors 145, which monitor different downhole parameters and generate data that is stored within one or more different storage mediums within the downhole tool 124. Alternatively, however, the data may be transmitted to a remote location (e.g., surface) and processed accordingly. The type of downhole tool 124 and the type of sensors 145 thereon may be dependent on the type of downhole parameters being measured. Such parameters may include the downhole temperature and pressure, the various characteristics of the subsurface formations (such as resistivity, radiation, density, porosity, etc.), the characteristics of the borehole (e.g., size, shape, etc.), etc.

Downhole tool 124 further includes a power source 149, such as a battery or generator. A generator could be powered either hydraulically or by the rotary power of the drill string. In this illustrative embodiment, downhole tool 124 includes a formation testing tool 150, which can be powered by power source 149. In an embodiment, formation testing tool 150 is mounted on drill collar 122. Formation testing tool 150 engages the wall of borehole 112 and extracts a sample of the fluid in the adjacent formation via a flow line. As will be described later in greater detail, formation testing tool 150 extracts a fluid sample from wellbore 112, whereby the gas phase of the sample is then extracted using a depressurization module of the formation testing tool 150. The extracted gas is then analyzed by one or more gas sensors onboard formation testing tool 150, whereby one or more components of the fluid sample are determined. The determination may be made in-situ using processing circuitry located on tool 150, or the measurement data may be transmitted to a remote location for processing.

In yet other embodiments, the extracted fluid samples may be inserted into a sample carrier 155. Formation testing tool 150 then injects carrier 155 into the return mud stream that is flowing intermediate the borehole wall 112 and drill string 108, shown as drill collars 122 in FIG. 1. Sample carrier(s) 155 flow in the return mud stream to the surface and to mud pit or reservoir 134. A carrier extraction unit 160 is provided in the reservoir 134, in an embodiment. The carrier extraction unit 160 removes the carrier(s) 155 from the drilling mud.

FIG. 1 also illustrates an alternative embodiment in which a wireline system 170 is deployed. In such an embodiment, wireline system 170 may include a downhole tool body 171 coupled to a base 176 by a logging cable 174. Logging cable 174 may include, but is not limited to, a wireline (multiple power and communication lines), a mono-cable (a single conductor), and a slick-line (no conductors for power or communications). Base 176 is positioned above ground and optionally includes support devices, communication devices, and computing devices. Tool body 171 houses a formation testing tool 150 that acquires samples from the formation. In an embodiment, power source 149 is positioned in tool body 171 to provide power to the formation testing tool 150. In certain other embodiments, tool body 171 may further include additional testing equipment 172. In operation, wireline system 170 is typically sent downhole after the completion of a portion of the drilling. More specifically, drill string 108 creates borehole 112, then drill string 108 is removed, and wireline system 170 is inserted into borehole 112, as will be understood by those ordinarily skilled in the art having the benefit of this disclosure.

Figure 2:
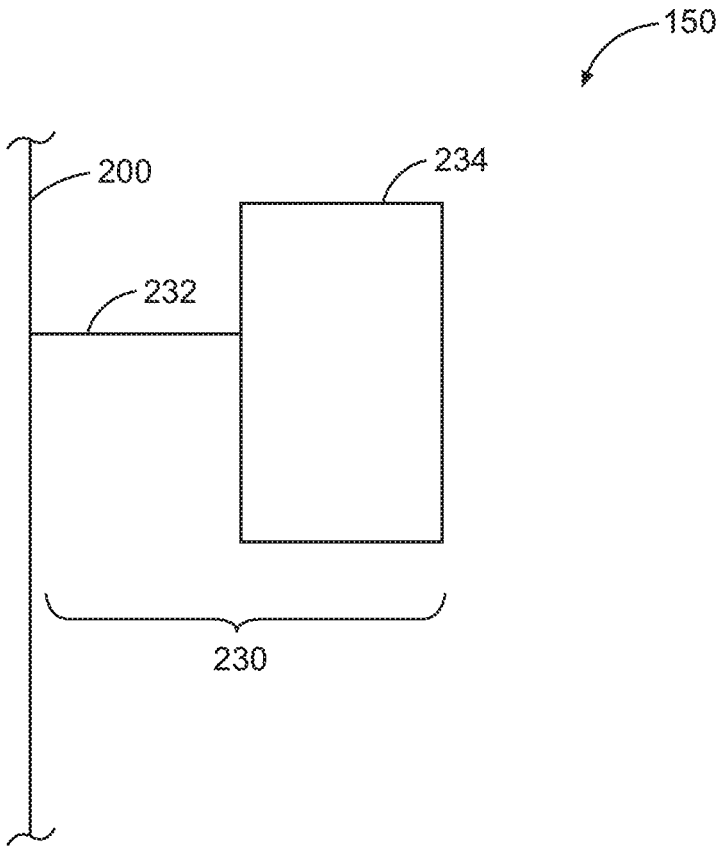
FIG. 2 illustrates a high-level block diagrammatical representation of a downhole tool, according to certain illustrative embodiments of the present disclosure.

FIG. 2 illustrates a high-level block diagrammatical representation of a downhole tool, according to certain illustrative embodiments of the present disclosure. Formation testing tool 150 includes a main flow line 200 through which pumping operations occur, and/or fluid sampling occurs. Tool 150 further includes a measurement module 230 (also referred to herein as "sample depressurization module") coupled with main flow line 200. Measurement module 230 includes an isolation line 232 and a mechanism for drawing fluid through the isolation line 232. For example, measurement module 230 may include at least one isolation pump 234. Isolation pump 234 includes, but is not limited to, a single piston pump, a dual reciprocating pump, or a combination thereof. In another embodiment, measurement module 230 does not need a piston to draw fluid into measurement module 230. For example, measurement module 230 includes a centrifuge to create flow through isolation line 232. In another option, a flow is produced through isolation line 232 using a parallel path, for example, using the flow produced by another pump, such as a pump independent from measurement module 230. Optionally, in addition to the gas sensor measurements described herein, other isolated measurements may be made by bombarding the fluid acoustically, magnetically, using radiation or vibration or other methods to make measurements.

Measurement module 230 is used to manipulate a fluid independent of the flow line 200, for example, to determine the bubble point of the fluid, or other properties. Various methods can be used to measure the bubble point. In one illustrative method, a piston gradually reduces pressure in a chamber where the fluid sample is contained, while the pressure in the chamber is monitored. The pressure is reduced by increasing the volume in the chamber (e.g. cylinder), for example by retracting a piston within the chamber. The pressure of the chamber is monitored, and a bubble point may be determined by analyzing the pressure versus volume relationship, as will be understood by those ordinarily skilled in the art having the benefit of this disclosure.

Measurement module 230 can be used to manipulate a fluid sample of flow line 200, without affecting the operation of flow line 200 while the fluid sample is manipulated. For example, during pumping operations, fluid can be pumped or sampled via flow line 200, and measurement module 230 is used to manipulate the fluid without having to stop operation of flow line 200, for example. In another example, measurement module 230 can be used to manipulate the fluid sample of flow line 200 without substantially dropping the pressure significantly within flow line 200.

Figure 3A:
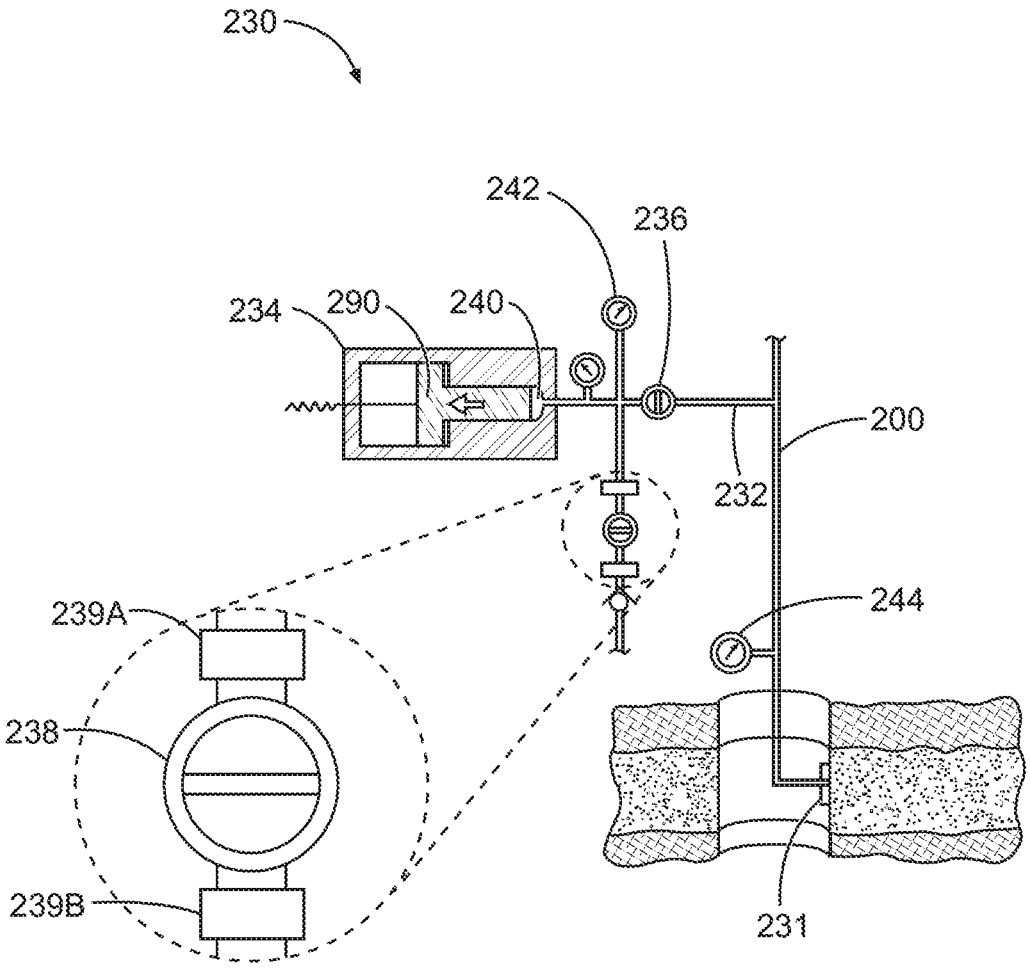
FIGS. 3A-3C illustrate a use of an example embodiment of a sample depressurization/measurement module of the present disclosure.
Figure 3B:
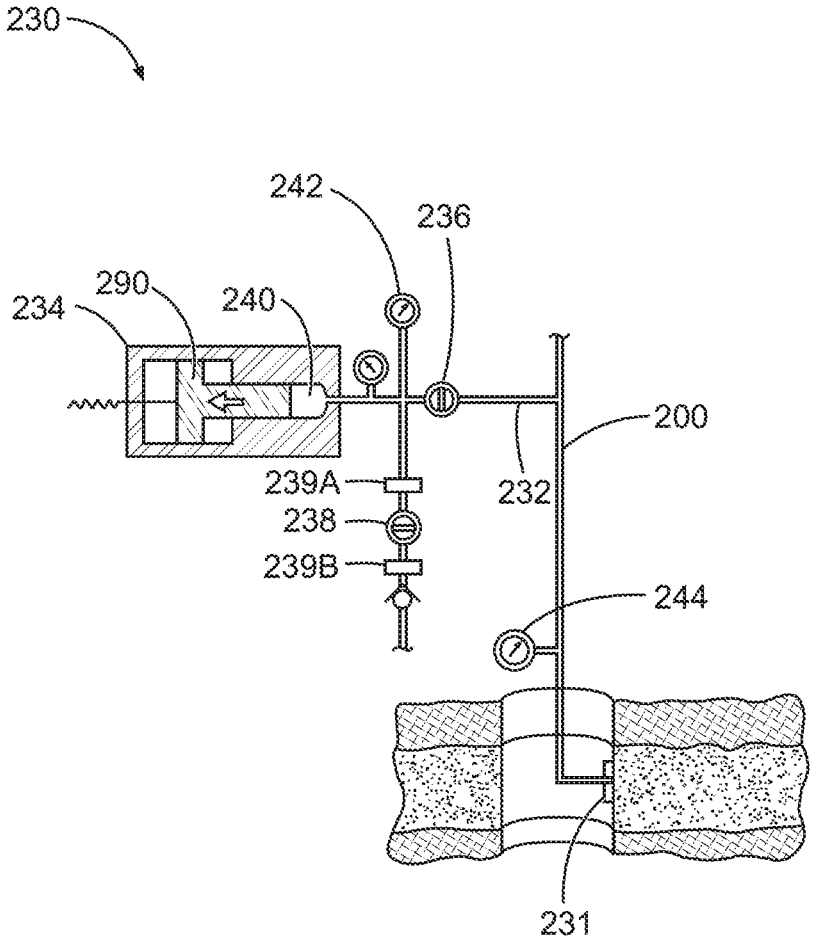
Figure 3C:
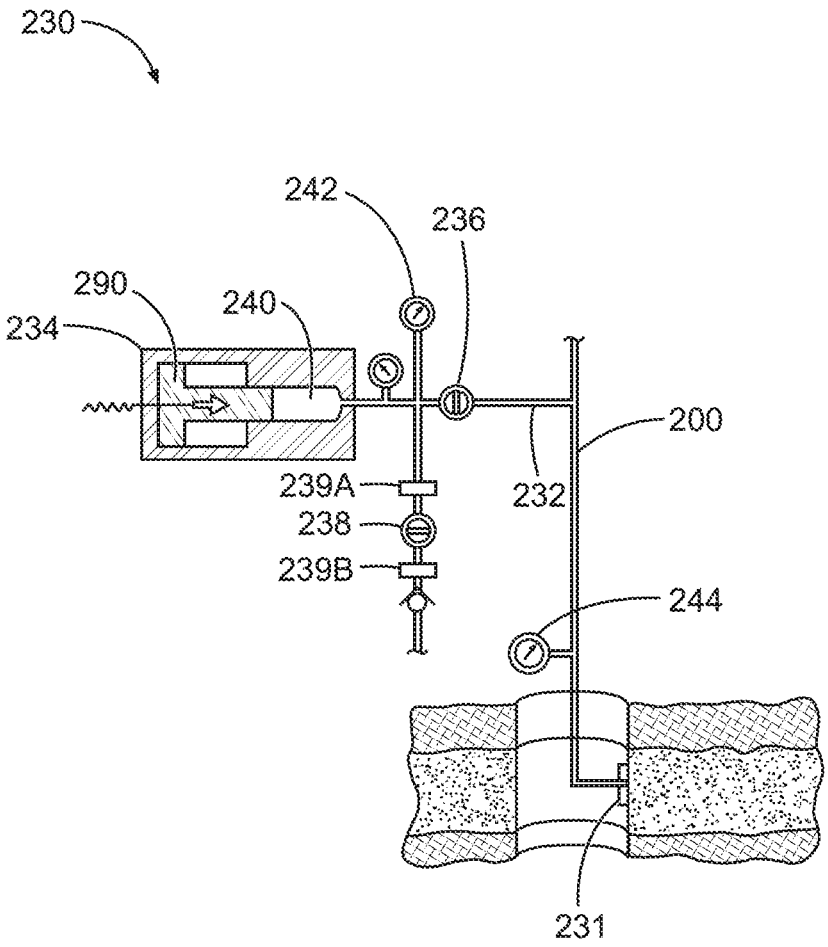

FIGS. 3A-3C illustrate sample depressurization/measurement module 230 during various stages of fluid analysis, according to certain illustrative embodiments of the present disclosure. Referring to FIGS. 2 and 3A, pump 234, or other measures for creating flow in the isolation line, is isolated from flow line 200 and optionally the borehole (FIG. 1) via, for example, one or more devices that can cease or otherwise restrict flow to the isolation line, for example, isolation valves 236. Alternatively, it should be noted that other devices other than valves can be used and are contemplated herein, such as, but not limited to, flow blockers, flow restrictors, etc., or any method to control movement of fluid. When the one or more isolation valves 236, or other devices, are opened, a fluid sample can be drawn from flow line 200 and into a chamber of measurement module 230. Once the chamber has sufficient sample fluid for manipulation, for example, sufficient to perform a bubble point measurement in certain embodiments, the one or more isolation valves 236, or other devices, can be closed allowing the fluid to be manipulated, for example to obtain a bubble point.

In this embodiment, measurement module 230 further includes one or more exhaust isolation valves 238 that can be opened and the used sample fluid is expelled into the borehole, and optionally may be expelled through a check valve. In a further embodiment, valve 238 is a check valve, or includes other structure to limit the flow of fluid in one direction. It should be noted that other devices can be used in place of valves 238 or in combination with valves 238, such as, but not limited to flow blockers, flow restrictors, etc. The pressure before, between, or after valves 236, 238 is optionally equalized before they are open for one or both of the inlet and exhaust processes.

In FIG. 3A, the area surrounding isolation valve 238 has been exploded to show further features of the present disclosure. In one or more embodiments, one or more gas sensors can be disposed proximate the exhaust valve 238. For example, a first gas sensor 239A may be positioned on a first side of exhaust valve 238. Gas sensor 239 is in fluid communication with chamber 240 of measurement module 230, as can be seen. A second gas sensor 239B may be positioned on the opposite side of exhaust valve 238. However, in other embodiments, a single gas sensor may be utilized. The choice of one or multiple gas sensors will be dictated by the need for redundancy in crucial situations where an early understanding of the presence of contaminants like $H_2S$, for example, can be expected to impact the further development of the hydrocarbon resource. In other instances the decision may be driven by the need to collect additional compositional data. Due to space constraints, any sensor will be limited in the number of analytes (components) it might be able to detect, and a second or more sensors will help to broaden the compositional understanding of the collected fluids.

Gas sensors 239A,B may take a variety of forms, such as, for example, an optical, acoustic or electromagnetic sensor sufficient to analyze components of a gas sample. The optical sensor may be in the form of an optical computing device. In general, an optical computing device is a device configured to receive an input of electromagnetic radiation from a sample and produce an output of electromagnetic radiation from a processing element, also referred to as an optical element, wherein the output reflects the measured intensity of the electromagnetic radiation. The optical computing device may be, for example, an Integrated Computational Element ("ICE"). One type of an ICE is an optical thin film interference device, also known as a Multivariate Optical Element ("MOE").

Fundamentally, optical computing devices utilize optical elements to perform calculations, as opposed to the hard-wired circuits of conventional electronic processors. When light from a light source interacts with a substance, unique physical and chemical information about the substance is encoded in the electromagnetic radiation that is reflected from, transmitted through, or radiated from the sample. Thus, the optical computing device, through use of the MOE and one or more detectors, is capable of extracting the information of one or multiple components/analytes within a substance and converting that information into a detectable output signal reflecting the overall properties of a sample. Such components may include, for example, the presence of certain elements, compositions, fluid phases, etc. existing within the substance. Such components may include the presence of mercury, $CO_2$, C1-C6 and higher hydrocarbons, nature of hydrocarbon systems such as the distribution of saturates, aromatics, resins, and asphaltenes (SARA) in a collected sample, or HF components. The operation or use of such optical devices will be understood by those ordinarily skilled in the art having the benefit of this disclosure.

As will be described in more detail below, after the gas has been liberated from the fluid sample in chamber 240, the gas is released via exhaust valve 238, whereby the gas will encounter gas sensors 239A,B. Here, the gas may be analyzed in-situ to determine the presence of various components which, as a result, will provide real-time information useful to downhole exploration. Furthermore, note that the design of measurement module 230 is illustrative in nature, and that various modifications may be made without departing from the inventive features described herein.

Figure 4:
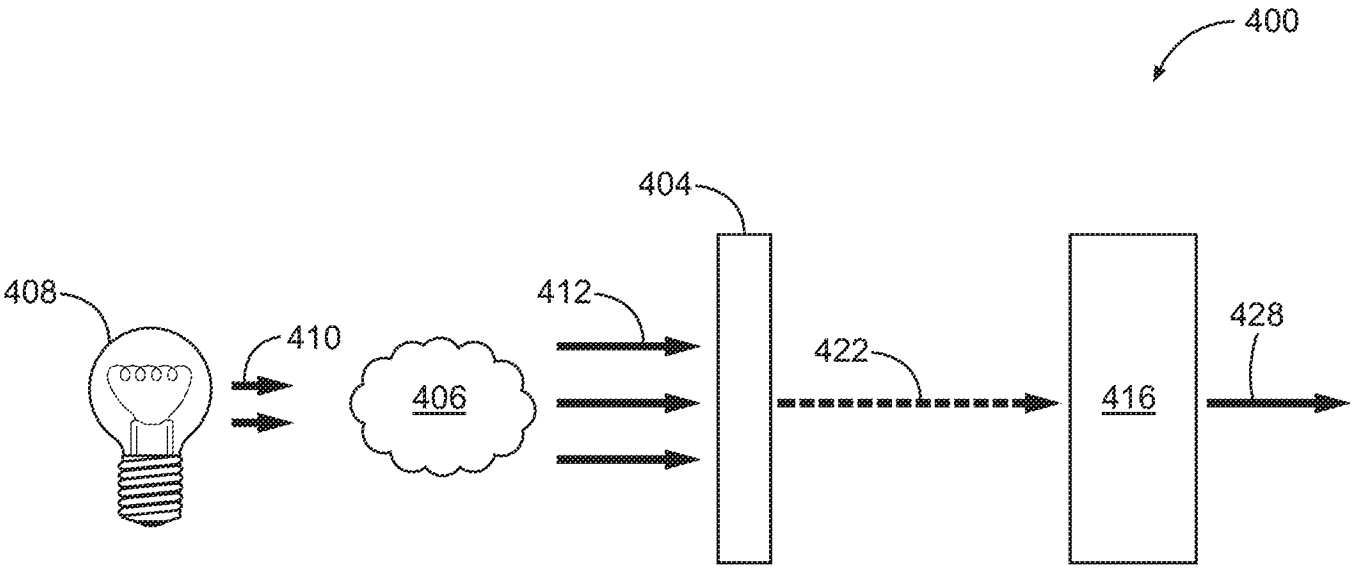
FIG. 4 is a block diagram of an illustrative architecture of an optical computing device used as the gas sensor.

FIG. 4 is a block diagram of an illustrative architecture of an optical computing device 400 used as the gas sensor 239. An electromagnetic radiation source 408 may be configured to emit or otherwise generate electromagnetic radiation 410. As understood in the art, electromagnetic radiation source 408 may be any device capable of emitting or generating electromagnetic radiation. For example, electromagnetic radiation source 408 may be a light bulb, light emitting device, laser, blackbody, photonic crystal, or X-Ray source, natural luminescence, etc. In one embodiment, electromagnetic radiation 410 may be configured to optically interact with the sample 406 (gas phase of fluid sample) to thereby generate sample-interacted light 412. In addition to gas, however, sample 406 may be any other desired sample, such as, for example, a liquid, solid substance or material such as, for example, hydrocarbons or food products. While FIG. 4 shows electromagnetic radiation 410 as passing through or incident upon the sample 406 to produce sample-interacted light 412 (i.e., transmission or fluorescent mode), it is also contemplated herein to reflect electromagnetic radiation 410 off of the sample 406 (i.e., reflectance mode), such as in the case of a sample 406 that is translucent, opaque, or solid, and equally generate the sample-interacted light 412.

After being illuminated with electromagnetic radiation 410, sample 406 containing an analyte of interest (a component of the sample) produces an output of electromagnetic radiation (sample-interacted light 412, for example). As previously described, sample-interacted light 412 also contains spectral information of the sample used to determine one or more components of sample 406. Although not specifically shown, one or more spectral elements may be employed in optical computing device 400 in order to restrict the optical wavelengths and/or bandwidths of the system and, thereby, eliminate unwanted electromagnetic radiation existing in wavelength regions that have no importance. As will be understood by those ordinarily skilled in the art having the benefit of this disclosure, such spectral elements can be located anywhere along the optical train, but are typically employed directly after the light source which provides the initial electromagnetic radiation.

As previously described, optical computing device 400 may be coupled to a remote or local power supply. Alternatively, however, a processor (i.e., processing circuitry) may be located remotely from optical computing device 400. In such embodiments, a communications link provides a medium of communication between the processor and optical computing device 400. The communications link may be a wired link, such as, for example, a fiber optic cable. Alternatively, however, the link may be a wireless link. In certain illustrative embodiments, the signal processor controls operation of optical computing device 400 (including the tilt angle of MOE 404). Optical computing device 400 may also include a transmitter and receiver (transceiver, for example) (not shown) that allows bi-directional communication over a communications link in real-time. In certain illustrative embodiments, optical computing device 400 will transmit all or a portion of the sample characteristic data to a remote processor for further analysis. However, in other embodiments, such analysis is completely handled by optical computing device 400 and the resulting data is then transmitted remotely for storage or subsequent analysis. In either embodiment, the processor handling the computations may, for example, analyze the characteristic data, or perform simulations based upon the characteristic data, as will be readily understood by those ordinarily skilled in the art having the benefit of this disclosure.

Still referring to the illustrative embodiment of FIG. 4, sample-interacted light 412 is then directed to MOE 404. Sample-interacted light 412 then optically-interacts with MOE 404 to produce optically interacted light 422 which corresponds to a component of gas phase. First optically-interacted light is then directed to detector 416, which may be any device capable of detecting electromagnetic radiation, and may be generally characterized as an optical transducer. For example, detector 416 may be, but is not limited to, a thermal detector such as a thermopile or photoacoustic detector, a semiconductor detector, a piezoelectric detector, charge coupled device detector, video or array detector, split detector, photon detector (such as a photomultiplier tube), photodiodes, local or distributed optical fibers, and/or combinations thereof, or the like, or other detectors known to those ordinarily skilled in the art. Detector 416 is further configured to produce an output signal 428 in the form of a voltage that corresponds to the component of the gas sample 406. In at least one embodiment, output signal 428 produced by detector 416 and the characteristic concentration of the sample 406 may be directly proportional. In other embodiments, the relationship may be a polynomial function, an exponential function, and/or a logarithmic function.

Although not shown, optical computing device 400 may also include a second detector to detect a normalizing signal, as will be understood by those ordinarily skilled in the art having the benefit of this disclosure. Electromagnetic radiation propagating through computing device 400 may include a variety of radiating attenuations stemming from electromagnetic radiation source 408 such as, for example, intensity fluctuations in the electromagnetic radiation, interferent fluctuations (for example, dust or other interferents passing in front of the electromagnetic radiation source), combinations thereof, or the like. Thus, the second detector detects such radiating deviations as well. In an alternative embodiment, the second detector may be arranged to receive a portion of the sample-interacted light 412, and thereby compensate for electromagnetic radiating deviations stemming from the electromagnetic radiation source 408. In yet other embodiments, the second detector may be arranged to receive a portion of electromagnetic radiation 410, and thereby likewise compensate for electromagnetic radiating deviations stemming from the electromagnetic radiation source 408. Those ordinarily skilled in the art having the benefit of this disclosure will realize there are a variety of design alterations which may be utilized in conjunction with embodiments of the present disclosure.

Although not shown in FIG. 4, in certain illustrative embodiments, detector 416 may be communicably coupled to a signal processor (not shown), where both are disposed on-board optical computing device 400 such that signal 428 and the normalizing signal indicative of electromagnetic radiating deviations may be provided or otherwise conveyed thereto. The signal processor may then be configured to computationally combine the normalizing signal with output signal 428 to provide a more accurate determination of the one or more components of sample 406. However, in the embodiment of FIG. 4, the signal processor would be coupled to the one detector. Nevertheless, in those embodiments using two detectors, for example, the signal processor computationally combines the normalizing signal with output signal 428 via principal component analysis techniques such as, for example, standard partial least squares which are available in most statistical analysis software packages (for example, XL Stat for MICROSOFT® EXCEL®) the UNSCRAMBLER® from CAMO Software and MATLAB® from MATHWORKS®), as will be understood by those ordinarily skilled in the art having the benefit of this disclosure. Thereafter, the resulting data is then transmitted to the processor for further operations to determine the component of sample 406 for which MOE 404 was designed. Note that there are a variety of other designs for optical computing device 400 which are not described herein and, thus, the design of device 400 is only illustrative in nature.

Now that an illustrative design of the sample depressurization/measurement module components of the downhole tool have been described, an illustrative downhole operation will now be discussed. With reference to FIGS. 1, 2, and 3A-3C, wellbore 112 is drilled as previously described. As drilling continues or between drilling runs, downhole sampling of the wellbore fluid is conducted via flowline 200. In order to access true, uncontaminated formation fluids, a pumping operation is conducted in order to purge the "packed-off" formation of interest (at pad 231) of drilling fluid filtrate.

Once the pumping has achieved a steady state flowing condition from the formation, usually a single phase liquid fluid is drawn from flow line 200, for example, but not limited to, with pump 234. A fluid sample is extracted from flowline 200 in order to make relatively continuous measurements regarding the quality of the flowline fluids without having to stop the primary pumping operation. The process can be repeated as desired. For example, the bubble point may be measured frequently, such as every 1 to 5 minutes. Once the bubble point measurement has been conducted, the extracted gas is allowed to exhaust back into the wellbore via exhaust valve 238. Before the gas is expelled however, it first flows past gas sensors 239A,B, whereby the presence of various components are determined.

FIGS. 3A-3C illustrate a use of an example embodiment of a sample depressurization/measurement module 230. As discussed previously, FIG. 3A illustrates the sample depressurization/measurement module 230 with the pump 234, such as a single piston pump, and further including the isolation valve 236 and the exhaust isolation valve 238. During operation, piston 290 of the pump 234 is moved to equalize the pressure across the isolation valve 236. This pressure equalization is indicated by the measurements of a test chamber pressure transducer 242 and a flowline pressure transducer 244. Isolation valve 236 is placed in the open position allowing for chamber 240 to intake fluid from the flowline (FIG. 3B) via pad 231 and isolation line 232. The fluid sample is drawn into chamber 240 at a rate so as to not substantially drop the pressure of the flowline (FIG. 3B). In an example, the flowline pressure is not dropped more than 1-4 psi. In another example, the flowline pressure is not dropped below the bubble point. In yet another example, the fluid is drawn at a rate of about 0.1 cc/sec, for example, to ensure the pressure is not dropped in heavy oil or low permeability rocks.

When a sufficient fluid sample has been acquired to perform a desired measurement or fluid manipulation, valve 236 can be closed. In certain embodiments, the measurement operation may be a bubble point measurement which, by definition, requires that a gas phase be liberated from a single phase liquid. In an example, piston 290 is moved to increase the volume in the chamber, and the trapped fluid will be gradually reduced in pressure by the increase in volume. A gauge (not shown) optionally monitors one or more conditions of the fluid, for example the pressure and the pressure vs. volume gradient of the fluid, and a determination of the bubble point will be made. Although not shown, sample depressurization/measurement module 230 may be coupled to processing circuitry which controls operation of the components (e.g., pistons, valves, etc.) of module 230. After the bubble point has been measured, the volume of the gas is expanded to the maximum volume available in chamber 240 (via manipulation of piston 290) and the adjoining tubing, thus resulting in the maximum volume of gas being liberated. The maximum volume is especially useful because the larger the volume, the lower the pressure, and the greater the amount of components desired to be measured in the gas phase.

When isolation valve 236 is closed, the gas is expanded such that it encounters gas sensors 239A,B, which conducts gas component analysis. Here, the presence of various components may be detected, such as, for example, mercury, $H_2S$, $CO_2$, C1-C6 hydrocarbons and HF. Although not shown, in one or more embodiments, gas sensors 239A,B form part of an optical computing device that is coupled to a local or remote power supply. The optical computing device may also comprise a signal processor (not shown), communications module (not shown) and other circuitry necessary to achieve the objectives of the present disclosure, as will be understood by those ordinarily skilled in the art having the benefit of this disclosure. It will also be recognized that the software instructions necessary to carry out the objectives of the present disclosure may be stored within storage located on the optical computing device or loaded into that storage from a CD-ROM or other appropriate storage media via wired or wireless methods. In those alternative embodiments utilizing other suitable gas sensors, these and other circuitry necessary to conduct component analysis may also be present.

Once component analysis of the liberated gas has been conducted, exhaust isolation valve 238 is opened (FIG. 3C) and the manipulated sample fluid (gas and liquid phase) is expelled from the chamber 240 via valve 238 and into the borehole, or collected, or moved to another measurement process.

As previously described, the design of sample depressurization/measurement module 230 may take on various forms. Regardless of the design, if the tool configuration is vertical, for example, and there is a valve isolating the sample depressurization chamber (e.g., bubble point measurement chamber) from the probe (e.g., pad 231), any suitable gas sensor located between the chamber and the further valve vertically removed from the chamber would be able to analyze the gas phase. Therefore, such a location would be preferable for the gas sensor to detect the desired components. If embodiments of the current disclosure are incorporated into a wireline formation tool, for example, the gas sensor may replace the conventional resistivity tool, as its location is preferable for the gas measurements.

In certain other illustrative methods of the present disclosure, the measured concentration of components in the gas phase will require adjustment, as the raw data may not deliver absolute component concentrations. For example, if the gas phase were to be expanded to 1 atmosphere, the measured $H_2S$ reading would be quantitative. However, as this is not feasible (because the sample is at some high pressure and dropping to an atmospheric pressure will require expanding into a very large volume, which is simply not available in a downhole tool), at any higher pressure there will be a partitioning of the H2S between the between the gas and liquid phases and, thus, this partitioning will need to be accounted for when quantifying the actual concentration of H2S relative to the measured value in the gas phase. To conduct this accounting, Pressure-Volume-Temperature ("PVT") data may be utilized, as the PVT data will provide the correlations necessary to accurately translate the measured component concentrations to absolute component concentrations. The translations will depend upon the bubble point pressures and how far below the bubble point the system pressure was taken to release the gas phase for analysis. There are a variety of methods by which to perform such calculations, as will be understood by those ordinarily skilled in the art having the benefit of this disclosure.

As mentioned herein, illustrative methods of the present disclosure may be utilized to detect various sensitive components such as, for example, $CO_2$, C1, C2, C3, C4-C5, mercury (Hg), and C6, all of which can be expected to concentrate in the gas phase when a bubble of gas is released. Depending on the reservoir fluid temperature and pressure, in certain other methods components higher than C6 will be detectable because of their gas phase segregation, even though they cannot at present be isolated in the bulk liquid phase.

Even though the above method teaches specifically to a hydrocarbon sample, other illustrative methods may be applied to detecting trace components like $H_2S$, $CO_2$, HF, etc in an aqueous phase during a similar bubble point determination on a downhole water sample. By extension, embodiments of this disclosure may be applied to any variety of samples including, but not limited to, surface samples where a drop in pressure allows the release of a gas phase in which specific components can be more easily detected relative to their presence in a bulk liquid phase.

Furthermore, those ordinarily skilled persons described herein realize that, in addition to the various gas sensors described herein, embodiments of this disclosure are applicable to any other sensor mechanism useable for the purpose of chemical characterization of a hydrocarbon or non-hydrocarbon samples. In a broad sense, the methods would be applicable to any situation such as a spectroscopic analysis, where a sample is contacted with radiated energy, following which the interaction between the sample and radiated energy is subject to analysis and interpretation. Included in this broad choice of spectroscopic interpretation would be electromagnetic radiation across a wide range of wavelengths, optical signals, and acoustic signals. Essentially, any sensor used to detect trace components can expect to have its sensitivity and thus its performance improved by this method of isolating specific components in the gas phase so their presence is less masked by the other components surrounding them in say a bulk liquid phase. Accordingly, using the embodiments of the current disclosure, the accurate detection of various components of the hydrocarbon fluid is greatly improved.

Embodiments described herein further relate to any one or more of the following paragraphs:

1. A method for analyzing a downhole fluid sample, the method comprising: deploying a downhole tool into a wellbore, the downhole tool comprising a sample depressurizing module and a sensor; obtaining a fluid sample from the wellbore; liberating a gas phase from the fluid sample using the sample depressurizing module; and analyzing the gas phase using the sensor to thereby determine a presence of a component in the fluid sample.

2. A method as defined in paragraph 1, wherein determining the presence of the component comprises determining the presence of H2S.

3. A method as defined in paragraphs 1 or 2, wherein determining the presence of the component comprises: determining a measured concentration of H2S; and converting the measured concentration to an absolute concentration of H2S.

4. A method as defined in any of paragraphs 1-3, wherein converting the measured concentration to an absolute concentration comprises utilizing Pressure-Volume-Temperature ("PVT") data.

5. A method as defined in any of paragraphs 1-4, wherein determining the presence of the component comprises determining the presence of at least one of a mercury, CO2, C1-C6 or HF component.

6. A method as defined in any of paragraphs 1-5, wherein analyzing the gas phase using a sensor is achieved utilizing at least one of an optical, acoustic, or electromagnetic sensor.

7. A method as defined in any of paragraphs 1-6, wherein the optical sensor is an Integrated Computational Element ("ICE").

8. A method as defined in any of paragraphs 1-7, wherein obtaining the fluid sample comprises obtaining a hydrocarbon fluid sample.

9. A method as defined in any of paragraphs 1-8, wherein obtaining the fluid sample comprises obtaining an aqueous fluid sample.

10. A downhole tool for analyzing a downhole fluid sample, the tool comprising a sample depressurization module; a mechanism for drawing the fluid sample from a wellbore and into the sample depressurization module; and at least one gas phase sensor in fluid communication with the sample depressurization module to thereby determine a presence of a component of the fluid sample.

11. A downhole tool as defined in paragraph 10, further comprising an exhaust line coupled to the sample depressurization module, wherein the at least one gas sensor is positioned along exhaust line.

12. A downhole tool as defined in paragraphs 10 or 11, further comprising an exhaust valve positioned along the exhaust line, wherein: a first gas sensor is positioned on one side of the exhaust valve; and a second gas sensor is positioned on another side of the exhaust valve opposite the first gas sensor.

13. A downhole tool as defined in any of paragraphs 10-12, wherein the downhole tool is a formation testing tool.

14. A downhole tool as defined in any of paragraphs 10-13, wherein the sample depressurization module is a bubble point measurement module.

15. A downhole tool as defined in any of paragraphs 10-14, wherein the at least one gas phase sensor is an optical, acoustic, or electromagnetic sensor.

16. A downhole tool as defined in any of paragraphs 10-15, wherein the optical sensor is an Integrated Computational Element ("ICE").

17. A downhole tool as defined in any of paragraphs 10-16, wherein the component of the fluid sample comprises at least one of a mercury, CO2, C1-C6 or HF component.

18. A downhole tool as defined in any of paragraphs 10-17, wherein the component of the fluid sample comprises H2S.

Although various embodiments and methodologies have been shown and described, the disclosure is not limited to such embodiments and methodologies and will be understood to include all modifications and variations as would be apparent to one skilled in the art. For example, although described herein as forming part of a formation testing tool, embodiments of the present disclosure may be embodied within a dedicated downhole tool for detecting various fluid components. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A method for analyzing a downhole fluid sample, the method comprising:

deploying a downhole tool into a wellbore, the downhole tool comprising a sample depressurizing module and a sensor;

obtaining a fluid sample from the wellbore via an intake flow line in communication with a probe;

drawing the fluid sample into a chamber of the depressurizing module;

closing an isolation valve located between the probe and chamber;

liberating a gas phase from the fluid sample using a pump of the sample depressurizing module;

analyzing the gas phase using the sensor to thereby determine a presence of a component in the fluid sample; and expelling the fluid sample back into the wellbore using an exhaust valve coupled between the chamber and isolation valve.

2. A method as defined in claim 1, wherein determining the presence of the component comprises determining the presence of $H_2S$.

3. A method as defined in claim 1, wherein determining the presence of the component comprises:

determining a measured concentration of $H_2S$; and converting the measured concentration to an absolute concentration of $H_2S$.

4. A method as defined in claim 3, wherein converting the measured concentration to an absolute concentration comprises utilizing Pressure-Volume-Temperature ("PVT") data.

5. A method as defined in claim 1, wherein determining the presence of the component comprises determining the presence of at least one of a mercury, $CO_2$, C1-C6 or HF component.

6. A method as defined in claim 1, wherein analyzing the gas phase using a sensor is achieved utilizing at least one of an optical, acoustic, or electromagnetic sensor.

7. A method as defined in claim 6, wherein the optical sensor is a multivariate optical element.

8. A method as defined in claim 1, wherein obtaining the fluid sample comprises obtaining a hydrocarbon fluid sample.

9. A method as defined in claim 1, wherein obtaining the fluid sample comprises obtaining an aqueous fluid sample.

10. A downhole tool for analyzing a downhole fluid sample, the tool comprising:

a sample depressurization module;

a mechanism for drawing the fluid sample from a wellbore, through an intake flow line, and into a chamber of the sample depressurization module;

an isolation valve located between the mechanism and chamber;

at least one gas phase sensor in fluid communication with the sample depressurization module to thereby determine a presence of a component of the fluid sample; and an exhaust valve to expel the fluid sample back into the wellbore, the exhaust valve being coupled between the chamber and isolation valve.

11. A downhole tool as defined in claim 10, further comprising an exhaust line coupled to the sample depressurization module, wherein the exhaust valve and at least one gas sensor is positioned along the exhaust line.

12. A downhole tool as defined in claim 11, wherein:

a first gas sensor is positioned on one side of the exhaust valve; and a second gas sensor is positioned on another side of the exhaust valve opposite the first gas sensor.

13. A downhole tool as defined in claim 10, wherein the downhole tool is a formation testing tool.

14. A downhole tool as defined in claim 10, wherein the sample depressurization module is a bubble point measurement module.

15. A downhole tool as defined in claim 10, wherein the at least one gas phase sensor is an optical, acoustic, or electromagnetic sensor.

16. A downhole tool as defined in claim 15, wherein the optical sensor is a multivariate optical element.

17. A downhole tool as defined in claim 10, wherein the component of the fluid sample comprises at least one of a mercury, $CO_2$, C1-C6 or HF component.

18. A downhole tool as defined in claim 10, wherein the component of the fluid sample comprises $H_2S$.

* * * * *